US008819981B2

(12) United States Patent
Malik et al.

(10) Patent No.: US 8,819,981 B2
(45) Date of Patent: Sep. 2, 2014

(54) UNDER-FOLD FIREARM STOCK ASSEMBLY

(71) Applicants: Adnan Malik, Longwood, FL (US); Todd Massey, Daytona Beach, FL (US)

(72) Inventors: Adnan Malik, Longwood, FL (US); Todd Massey, Daytona Beach, FL (US)

( * ) Notice: Subject to any disclaimer, the term of this patent is extended or adjusted under 35 U.S.C. 154(b) by 0 days.

(21) Appl. No.: 13/739,386

(22) Filed: Jan. 11, 2013

(65) Prior Publication Data

US 2014/0196344 A1 Jul. 17, 2014

(51) Int. Cl.
*F41C 23/04* (2006.01)

(52) U.S. Cl.
CPC ..... *F41C 23/04* (2013.01)
USPC ..... 42/73; 42/72

(58) Field of Classification Search
CPC ..... F41C 23/16; F41C 23/04; F41A 23/10
USPC ..... 42/71.01, 71.02, 72, 74, 75.03, 73; 89/158, 37.04
See application file for complete search history.

(56) References Cited

U.S. PATENT DOCUMENTS

| | | | | |
|---|---|---|---|---|
| 2,462,091 | A * | 2/1949 | Garand | 42/72 |
| 4,735,007 | A * | 4/1988 | Gal | 42/72 |
| 5,924,233 | A * | 7/1999 | Strobel | 42/72 |
| 7,302,881 | B1 | 12/2007 | Tertin | |
| 8,109,026 | B1 * | 2/2012 | Bentley et al. | 42/73 |

* cited by examiner

*Primary Examiner* — Samir Abdosh
*Assistant Examiner* — John D Cooper
(74) *Attorney, Agent, or Firm* — Jason T. Daniel; Daniel Law Offices, P.A.

(57) ABSTRACT

An under-fold firearm stock assembly includes an elongated main body having a longitudinal channel and a firing mechanism opening. A stock and butt stock are positioned along the back of the main body, and a pivot assembly transitions the stock between an open and closed position.

9 Claims, 7 Drawing Sheets

UNDER-FOLD FIREARM STOCK ASSEMBLY

TECHNICAL FIELD

The present invention relates generally to firearms and more particularly to an under-fold firearm stock assembly for use with the RUGER® 10/22®.

BACKGROUND

The statements in this section merely provide background information related to the present disclosure and may not constitute prior art.

Many firearm owners routinely modify their weapons to suit a particular interest or desired look. To this end, it is a common practice for some to adapt or modify firearms to suit a particular need or desired look. Accordingly, there are a seemingly infinite number of aftermarket apparatuses and/or devices available to users in furtherance of this goal.

One of the most popular rifles for user customization is the commercially available RUGER® 10/22® semi-automatic 22 caliber rifle. This rifle, which is available in several variants, does not include an adjustable stock, which can be advantageous during storage and transport, as well as for use in a close quarter environment.

Accordingly, there remains a need for a under-fold firearm stock assembly which can function in an aftermarket capacity to provide this feature to a RUGER® 10/22® rifle.

SUMMARY OF THE INVENTION

The present invention is directed to an under-fold firearm stock assembly. One embodiment of the present invention can include an elongated main body having a longitudinal channel and opening to receive and engage a conventional rifle firing mechanism. A pivotally mounted stock and butt stock are positioned along the back of the main body. The stock can transition from an open position extending away from the main body, and a closed position beneath and alongside the main body.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1A:
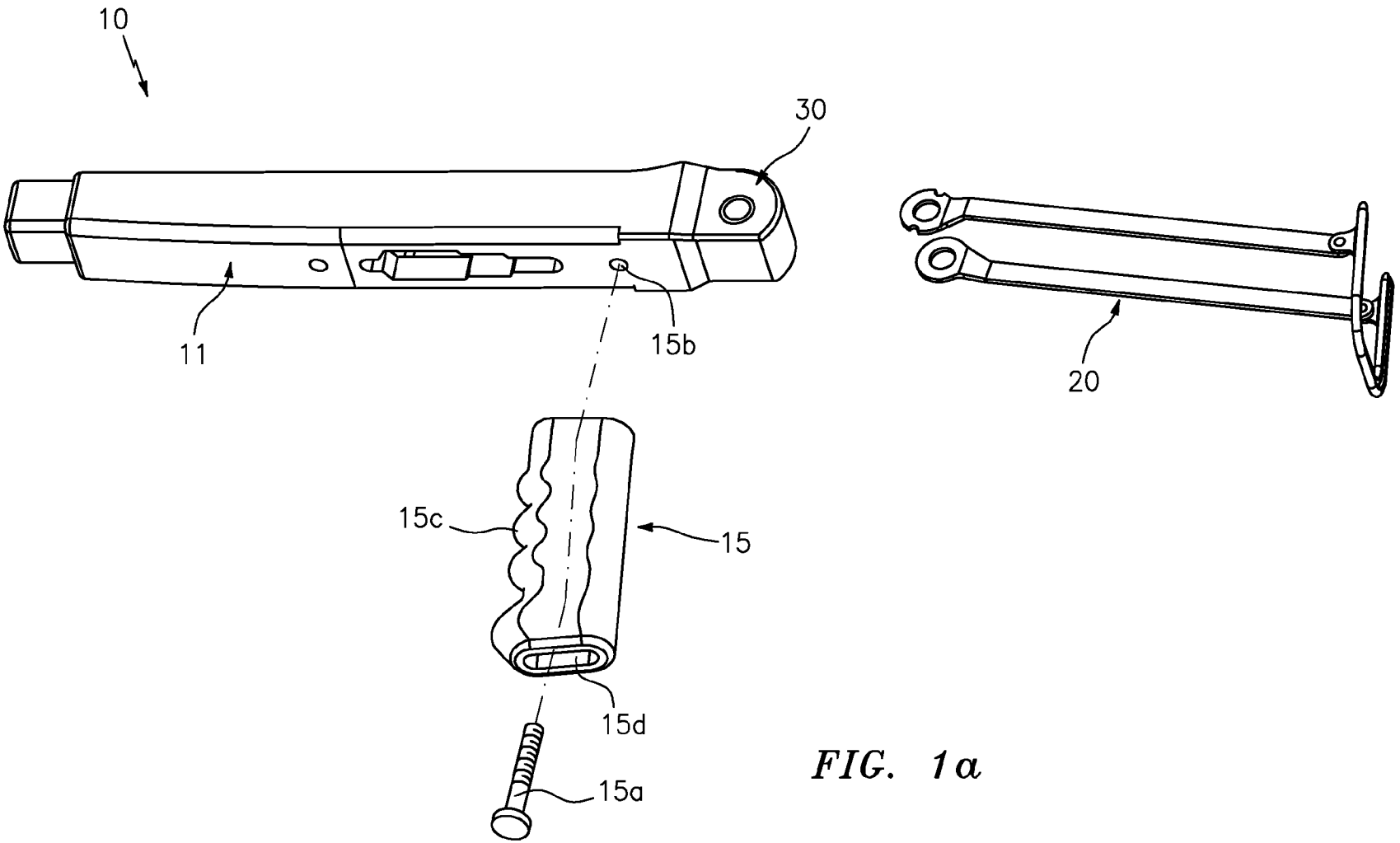
FIG. 1*a* is an exploded parts view of an under-fold firearm stock assembly, in accordance with one embodiment of the invention.
Figure 1B:
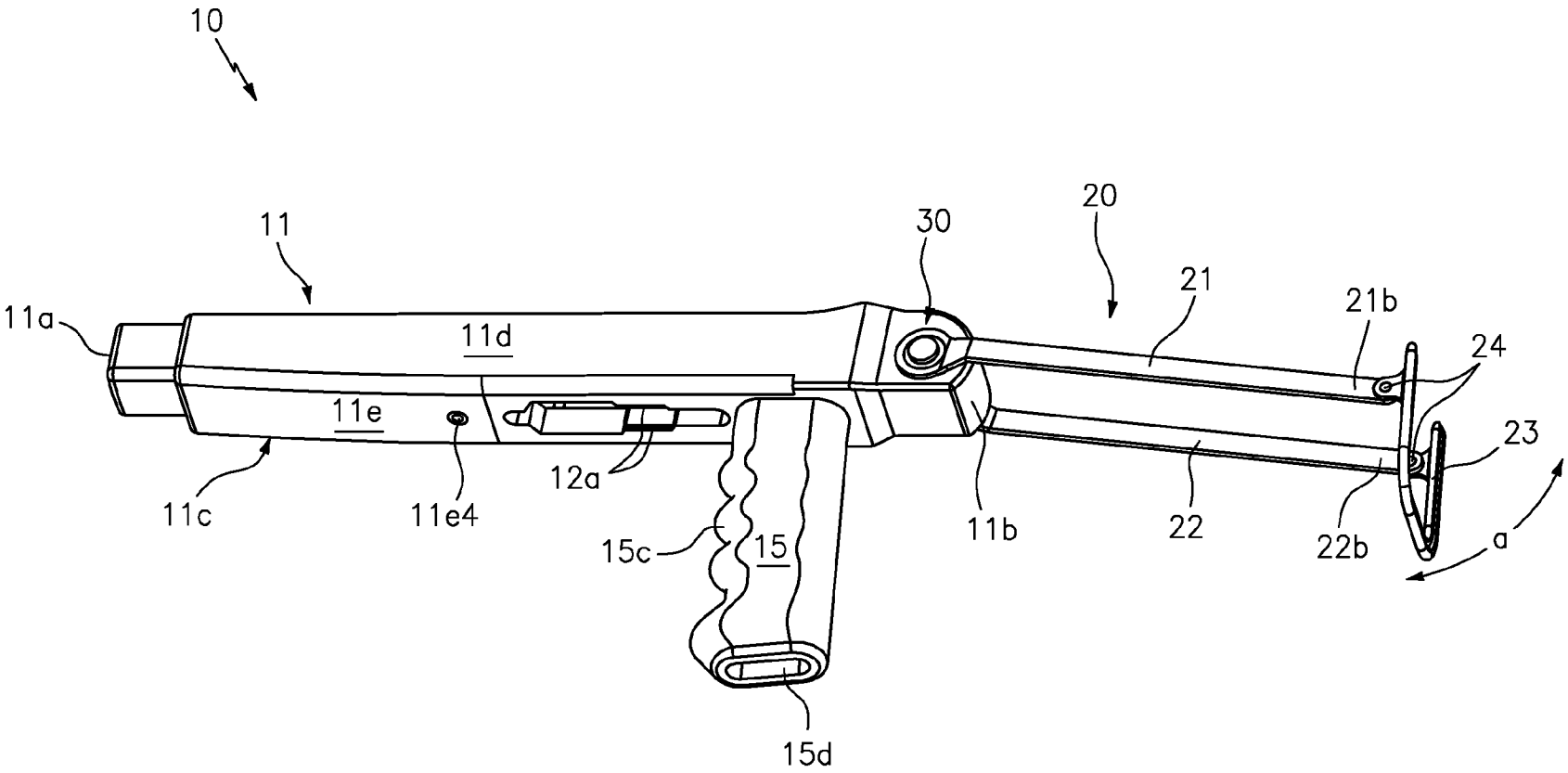
FIG. 1*b* is a perspective view of an under-fold firearm stock assembly, in accordance with one embodiment of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As will be described below, the present invention includes an under-fold firearm stock assembly designed to replace the butt stock, hand grip, and forearm grip of a factory RUGER® 10/22® semi-automatic 22 caliber rifle (herein described as "rifle"). To this end, the assembly will include dimensions for receiving the firing mechanism of the rifle and positioning the same into the assembly without requiring modification to the rifle firing mechanisms.

Although illustrated herein as for use with a particular rifle, those of skill in the art will recognize that other embodiments can be utilized with other firearms without departing from the invention claimed.

FIGS. 1*a*-4 illustrate one embodiment of the under-fold firearm stock assembly 10, which is useful for understanding the inventive concepts disclosed herein. As shown, the assembly 10 can include a main body 11 having a removable hand grip 15 and a pivotally mounted stock 20.

The main body 11 can act to receive a rifle firing mechanism 1 (see FIG. 5), and to function as a forearm stock for providing a safe grip for the forward hand of a user when operating the rifle. In one embodiment, the main body can include an elongated member having a front end 11*a*, a back end 11*b*, and a pair of opposing generally parallel side walls 11*c* and 11*d* that are joined together by a bottom wall 11*e* to form a generally U shaped longitudinal channel along the main body.

A pivot housing can be disposed along the back end of the main body and can be defined by an upper surface 11*f* blending into the top end of the side walls, the upper portion of the removable grip 15 and walls 11*c*, 11*d*, 11*b*, and 11*b*1. Each of these surfaces forming a generally cavernous space into which the pivot assembly 30 can be located.

The top surface of the bottom wall 11*e* can include a plurality of raised sections relative to the upper portions of the side walls 11*c* and 11*d*. In one embodiment, the upper side of the bottom wall can include a first raised section 11*e*1 for receiving a rifle barrel, a second raised section 11*e*2 extending below a received riffle barrel, and a third raised section 11*e*3 for receiving the connector of the firing mechanism. A bolt opening 11*e*4 can be positioned within the third raised section 11*e*3 of the bottom wall and positioned so as to receive a bolt for securing the main body into the connector of the firing mechanism.

As shown, a firing mechanism opening 12 extends from the edge of the third raised section 11*e*3 to the forward wall of the pivot housing 11*b*1. Opening 12 can also include a ridge 12*a* having a shape that is complementary to the ridge of the firing mechanism (see FIG. 5), so as to provide a shelf onto which the firing mechanism can be secured.

A removable hand grip 15 can be positioned along the bottom of the main body 11*e* at a location beneath the pivot housing. As shown, the grip can be secured to the main body via a bolt 15*a* and bolt receiver 15*b*, and can further include a rough surface area for increasing traction with the hand of a user, and a plurality of finger ridges 15*c*. An opening 15*d* along the bottom of the grip allows the bolt to be accessed at all times to enable a user to quickly change the grip.

Each of the main body 11 and the hand grip 15 can be constructed from any number of strong, impact resistant materials such as wood, metal or plastic, for example, capable of integrated into the construction of the opening 12, in accordance with known construction methodologies.

Figure 2:
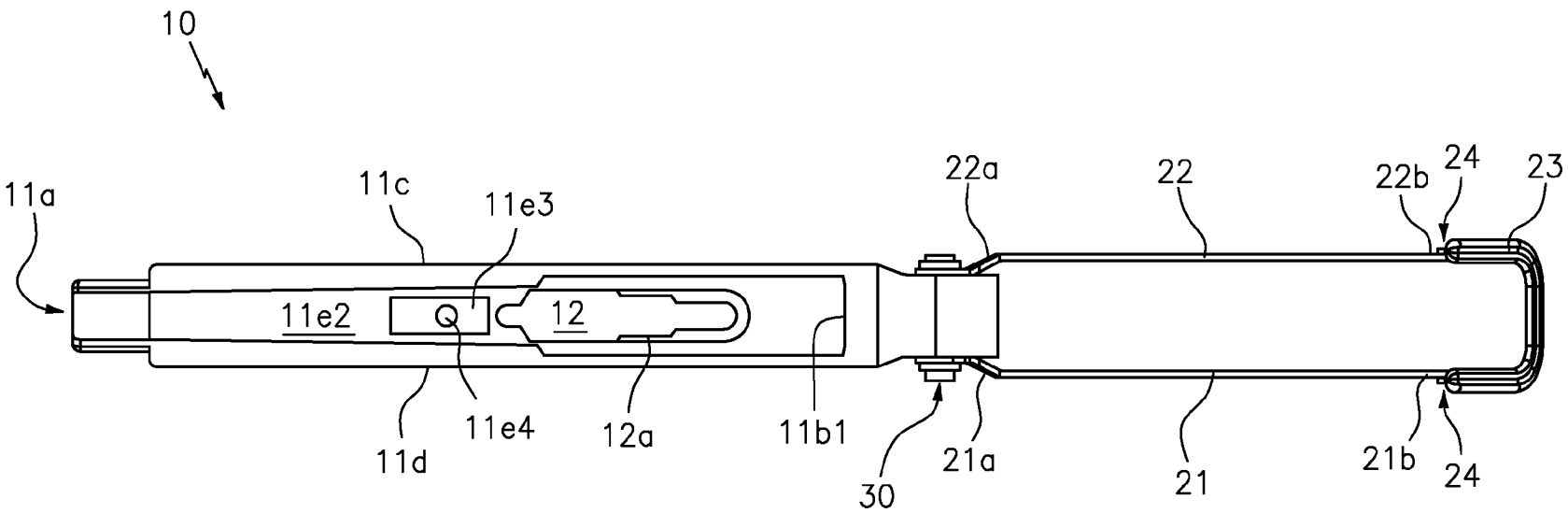
FIG. 2 is a top view of an under-fold firearm stock assembly, in accordance with one embodiment of the invention.

The elongated stock 20 can include a pair of laterally spaced elongated arms 21 and 22, each having a first end 21*a* and 22*a* (See FIG. 3) and a second end 21*b* and 22*b*, respectively. A generally U-shaped butt stock 23 can be secured to the second end of each arm via a pair of axel pins 24 to allow the butt stock to pivot, see arrow a, between a generally vertical/open position (FIG. 1) and a generally horizontal/closed position (FIG. 2).

In one embodiment, the elongated stock 20 can be secured to the back end of the main body so as to pivot from an open position to a closed position. In one preferred embodiment, the locking pivot assembly 30 described below can be utilized; however it is to be understood that any suitable device capable of transitioning the elongated stock between an open position and a closed position can be utilized herein.

Figure 3:
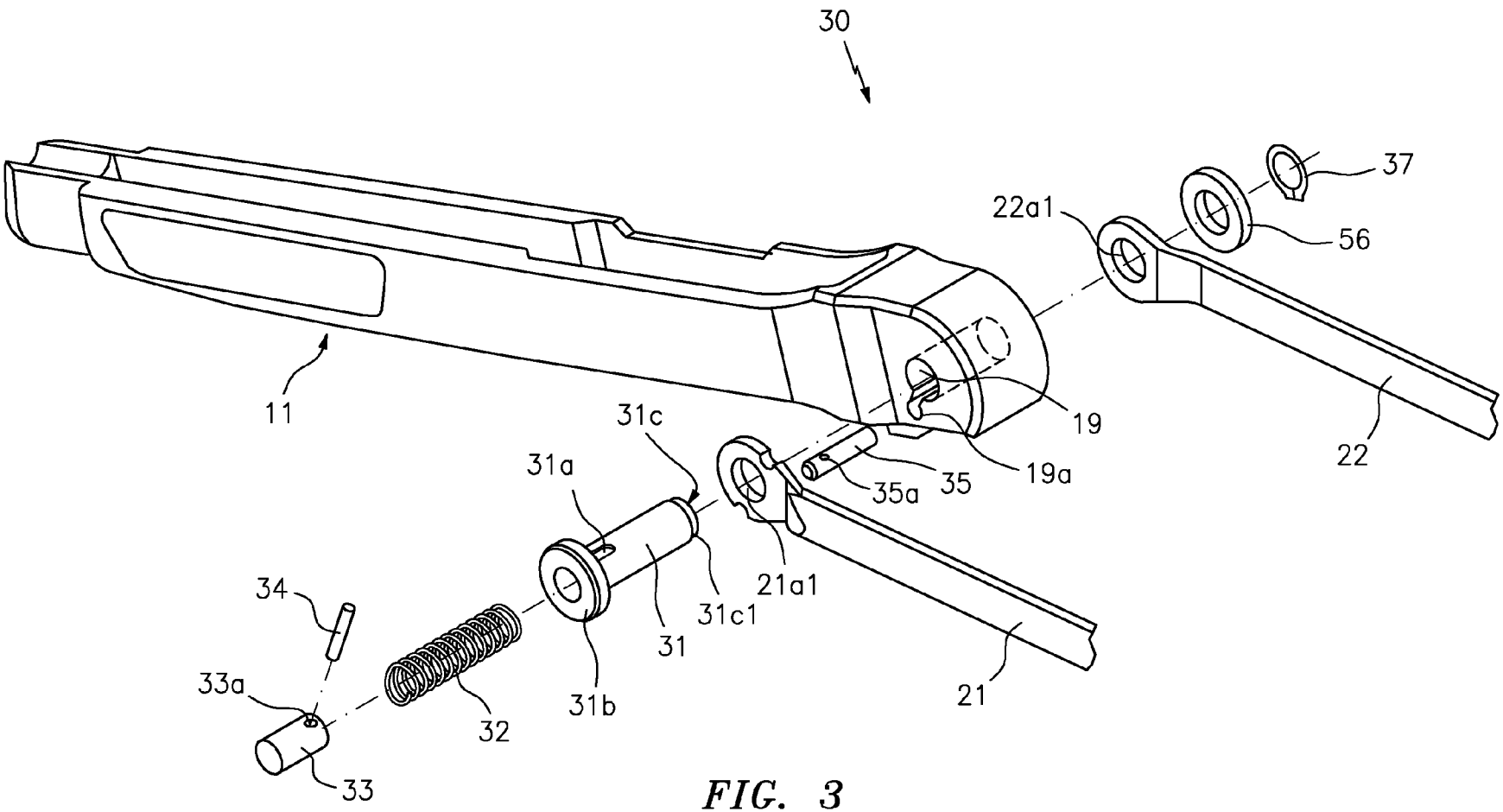
FIG. 3 is an exploded parts view of a pivot assembly for use with the firearm stock assembly, in accordance with one embodiment.

FIG. 3 illustrates one embodiment of a pivot assembly for use herein. As shown, the pivot assembly 30 can include an axel 31, a button spring 32, a button 33, a split pin 34, a lock pin 35, a washer 36, and a retaining ring 37.

The axel 31 can include an elongated hollow shaft having an outside dimension suitable for being inserted through the hole 21*a*1 of the stock arm 21, and a hollow inside dimension suitable for receiving the button spring 32 and button 33. The button spring 32 can be positioned within the hollow portion of the axel and can receive the button 33 on one end.

The split pin 34 can be inserted through openings 31*a* and 33*a* of the axel and button respectively, to prevent separation of the components. As such, the upper portion of the split pin 34 can be positioned flush with the upper portion of the axel, and the lower portion of the split pin can extend from the bottom of the axel. The extended portion of the split pin being configured to be inserted into the opening 35*a* of the locking pin 35.

As shown, the main body 11 can include a generally circular hollow channel 19 having a suitable inside dimension for receiving the axel 21. A second hollow channel 19*a* is blended into the lowermost portion of the channel 19 and includes a dimension suitable for receiving the locking pin 35. To this end, the axel 31 having the spring 32, the button 33 and the split pin 34 are inserted through the opening 21*a*1 of the stock arm 21 and into the opening 19. Likewise, the locking pin 35 is inserted into the opening 19*a*. As the axel includes an first end having an enlarged faceplate 31*b* with a dimension that is greater than opening 21*a*1, the axel remains within the opening 19.

When so positioned, the second end of the axel 31*c* will extend out of the channel 19 and through opening 22*a*1 of the second stock arm 22 and the washer 36. A small grove 31*c*1 is disposed along a periphery of the second side of the axel, and acts to receive a a retaining ring 37 to lock the assembly into place.

In operation, when the button 33 is pressed, the split pin 34 moves the lock pin 35 out of position, and allows the stock arms 21 and 22 to rotate around the axel. When the button 33 is released, the button spring 32 will place outward pressure on lock pin 35 through the button 33 and the split pin 34. When the stock arms 21 and 22 are rotated to a fully open position or a fully closed position, the lock pin 35 slides into position and secures the assembly in place. Accordingly, the assembly 30 acts to allow a user to rotate the stock arms a full 180 degrees between an open position (FIG. 2) and a closed position (FIG. 6) and to automatically lock the same.

Figure 4:
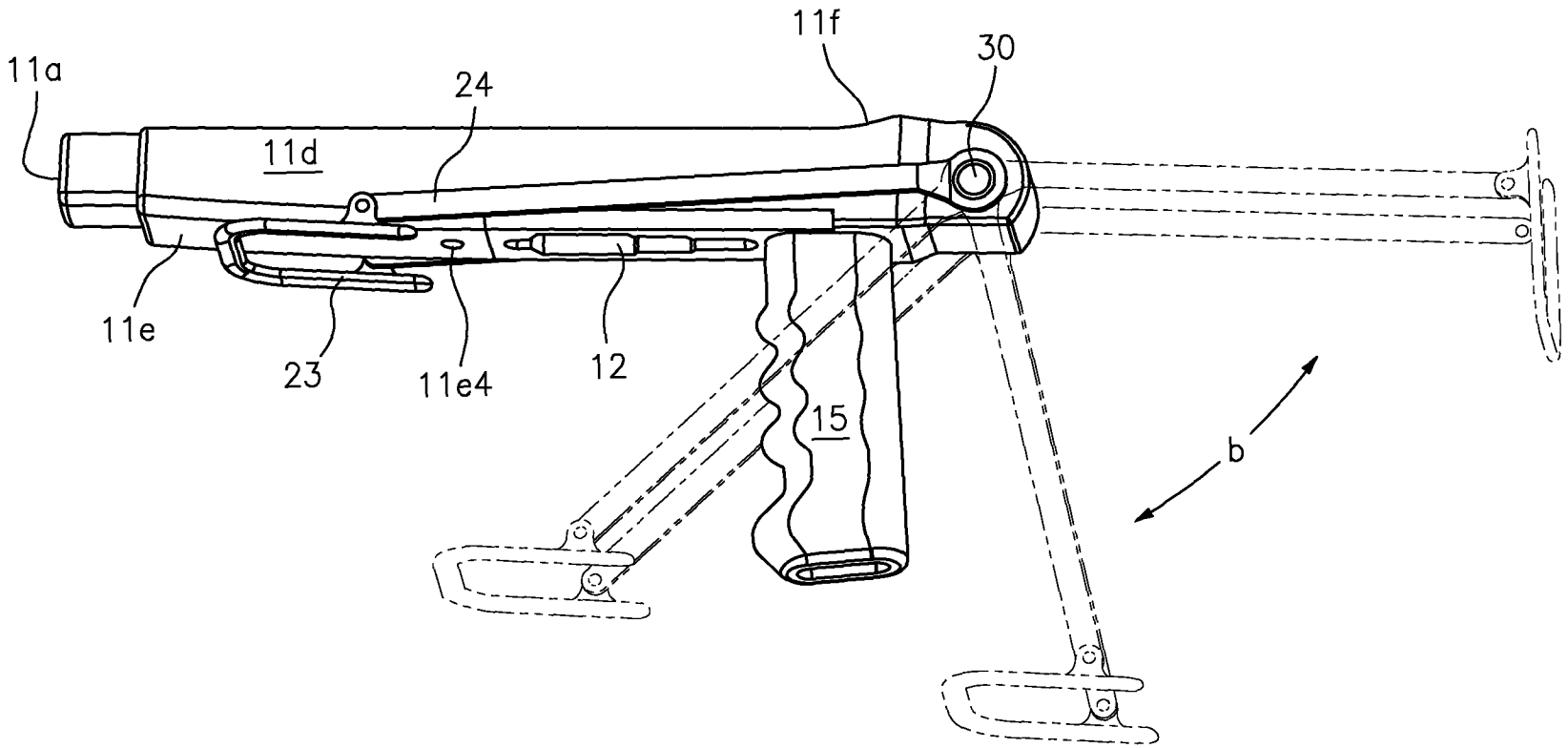
FIG. 4 is a perspective view of the under-fold firearm stock assembly, in accordance with another embodiment of the invention.

FIG. 4 illustrates the under-fold firearm stock assembly 10 transition from the open position to a closed position, wherein the stock arms 21 and 22 are rotated 180 degrees, see arrow b, about the pivot assembly until being positioned alongside main body side walls 11*d* and 11*c*, respectively. When so positioned, the butt stock 23 can be rotated to a closed position (see arrow a), so as to rest directly beneath the bottom wall of the main body 11*e*. When so located, the locking member of the pivot assembly can engage the openings, so as to prevent the arms from moving, as described above.

Figure 5:
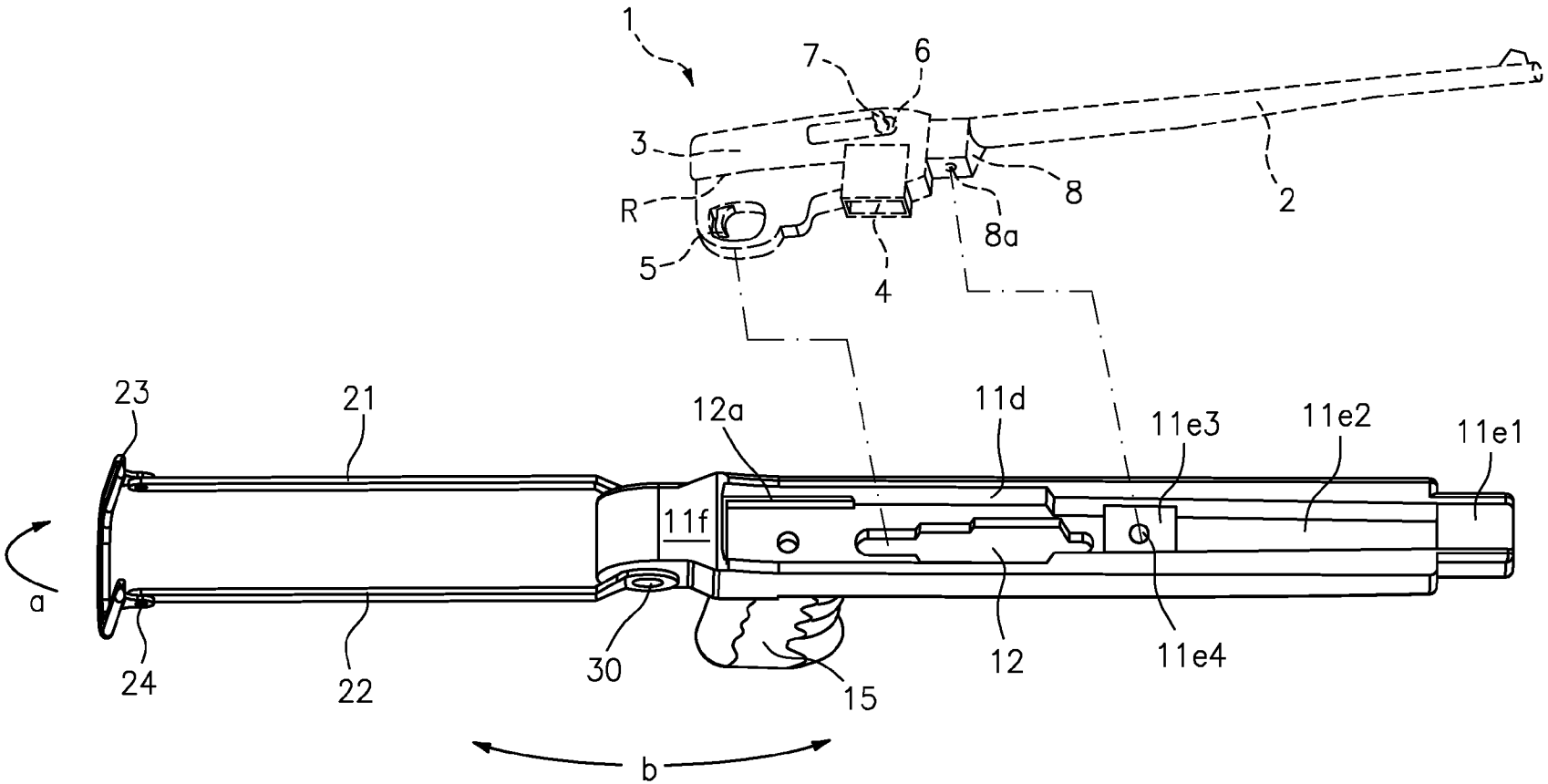
FIG. 5 is a perspective view of the under-fold firearm stock assembly in operation, in accordance with one embodiment of the invention.
Figure 6:
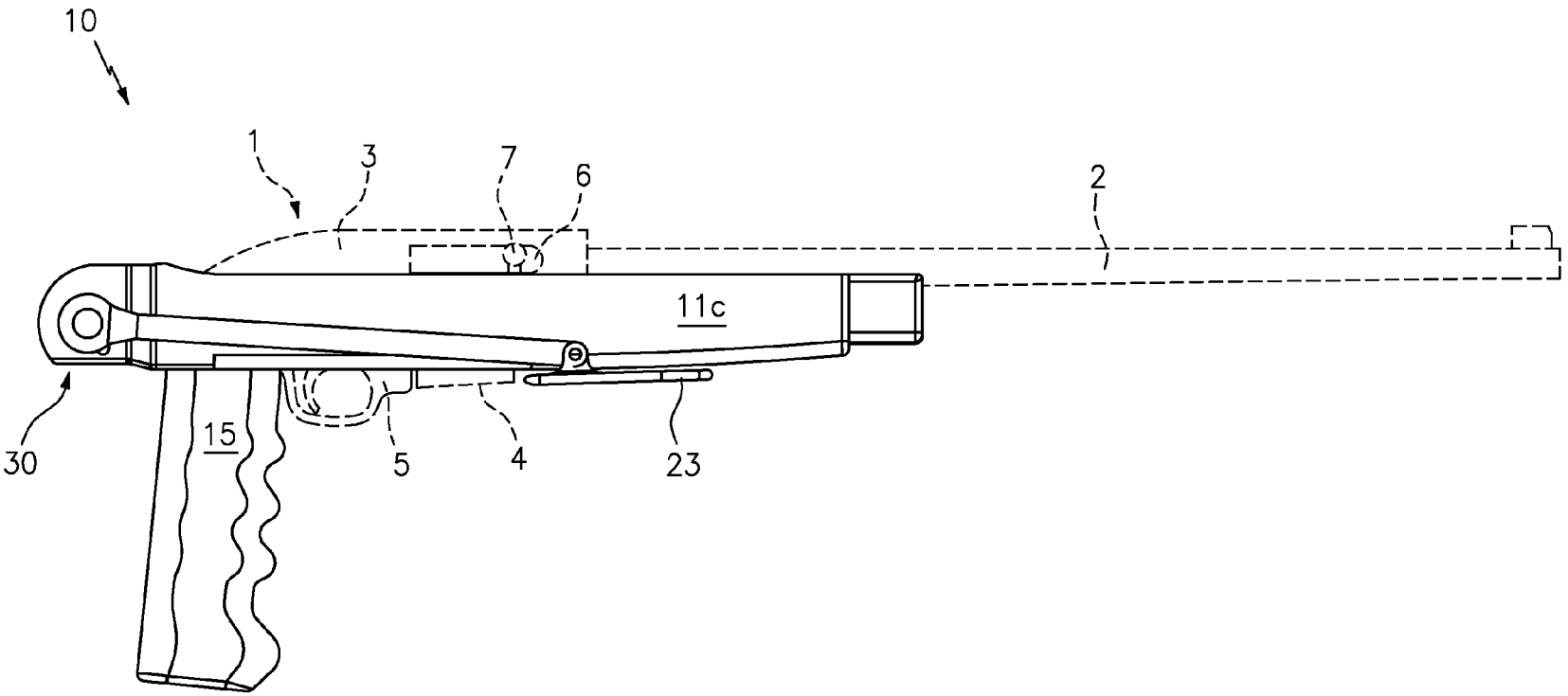
FIG. 6 is a side view of the under-fold firearm stock assembly in operation, in accordance with one embodiment of the invention.

FIGS. 5 and 6 illustrate one embodiment of the under-fold firearm stock assembly 10 in operation with the firing mechanism of a rifle. As shown, the rifle firing mechanism 1 can include a factory barrel 2, receiver 3, cartridge receiver 4, trigger guard assembly 5, bolt 6, and bolt operating handle 7. A ridge R separates the upper portion of the trigger guard assembly 5 and the lower portion of the receiver 4, and a stock connector 8 is positioned beneath the barrel at a location adjacent to the cartridge receiver. The stock connector including a threaded opening 8*a* for allowing the rifle stock to be bolted to the firing mechanism. These and other components of the rifle firing mechanism are described in U.S. Pat. No. 7,302,881, to Tertin, the contents of which are incorporated herein by reference.

Accordingly, the shape of the firing mechanism opening 12 of the main body conforms to the shape of firing mechanism 1 so as to allow the lowermost portions of the trigger assembly 5 and the cartridge receiver 4 to penetrate the opening 12 and be positioned beneath the bottom wall of the main body 11*e*. Additionally, the ridge 12*a*, the third raised section 11*e*3, and the first raised section 11*e*1 can act as a shelf upon which the ridge R, the stock connector 8 and the barrel 2 of the firing mechanism can rest, respectively. When so positioned, bolt opening 11*e*4 of the third raised section, and threaded opening 8*a* of the stock connector can be aligned so as to receive a bolt (not illustrated) for securing the firing mechanism 1 into the under-fold firearm stock assembly 10.

As described herein, one or more elements of the under-fold firearm stock assembly 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 11 and the grip 15, for example, may be formed together as one continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An under-fold firearm stock assembly, said stock assembly comprising:

a forearm stock that includes an elongated main body having a front end, a back end, pair of opposing generally parallel side walls joined together by a bottom wall and forming a generally U shaped channel, a first generally circular channel that is disposed along the back end of the main body and extending between the pair of opposing side walls, a second generally circular channel that is disposed along a lower portion of the first circular channel, said second channel extending between the pair of opposing side walls, a firing mechanism opening disposed within the bottom wall said opening including a ridge disposed therein, and a bolt opening disposed along the bottom wall of the main body, said bolt opening being interposed between the firing mechanism opening and the front end of the main body, wherein said bolt opening, firearm receiver opening and ridge are configured to receive and engage a conventional firing mechanism;

an elongated generally hollow hand grip that includes a main body having an upper end that is flush mounted to the bottom wall of the forearm stock via a connector, a middle section having a rough surface and a plurality of finger ridges, and a bottom surface that includes an opening, said opening functioning to provide access to the connector;

an elongated stock that includes a pair of laterally spaced arms each having a first end and a second end, and a butt stock pivotally secured to the second end of each of the laterally spaced arms; and a pivot assembly that is configured to transition the elongated stock between an open position and a closed position, said pivot assembly consisting of a generally hollow axel that is in communication with one of the pair of laterally spaced arms of the elongated stock, and the first channel of the forearm stock, a button spring that is in communication with an inside portion of the hollow axel, a button and split pin that are in communication with each of the axel and button spring, a lock pin that is in communication with the second channel of the forearm stock, and a retaining ring that is in communication with the other of the pair of laterally spaced arms, said retaining ring functioning to lock the elongated stock in each of the open and closed positions.

2. The under-fold firearm stock assembly of claim 1, wherein the elongated stock is configured to pivot 180 degrees about the pivot assembly.

3. The under-fold firearm stock assembly of claim 1, wherein the grip is configured to be removable.

4. The under-fold firearm stock assembly of claim 1, wherein the top surface of the bottom wall includes a plurality of raised sections configured to engage the conventional firing mechanism.

5. The under-fold firearm stock assembly of claim 1, wherein the pivot assembly is configured to lock each of the laterally spaced arms in a direction in-line and away from the back end of the main body in the open position.

6. The under-fold firearm stock assembly of claim 1, wherein the pivot assembly is configured to lock each of the laterally spaced arms alongside the side walls of the main body in the closed position.

7. The under-fold firearm stock assembly of claim 1, wherein the butt stock is configured to pivot between an open position and a closed position.

8. The under-fold firearm stock assembly of claim 1, wherein the butt stock is configured to make contact with the bottom surface of the bottom wall of the main body when each of the elongated stock and the butt stock are in the closed positions, respectively.

9. The under-fold firearm stock assembly of claim 1, wherein the conventional firearm consists of a RUGER 10/22.

* * * * *